United States Patent [19]

Warner

[11] Patent Number: 4,886,465

[45] Date of Patent: Dec. 12, 1989

[54] ELECTRICAL OUTLET PROTECTIVE COVER

[76] Inventor: Mark E. Warner, 810 Davis St., Milton-Freewater, Oreg. 97862

[21] Appl. No.: 204,610

[22] Filed: Jun. 9, 1988

[51] Int. Cl.[4] ..... H01R 13/44

[52] U.S. Cl. ..... 439/137; 439/489

[58] Field of Search ..... 439/137–140, 439/143, 145, 489

[56] References Cited

U.S. PATENT DOCUMENTS

| | | | |
|---|---|---|---|
| 1,955,513 | 4/1934 | Petersen | 439/489 |
| 2,710,382 | 6/1955 | Fitzpatrick et al. | 339/40 |
| 2,820,842 | 1/1958 | Meistrell | 174/67 |
| 3,068,442 | 12/1962 | Kubik et al. | 339/36 |
| 3,775,726 | 11/1973 | Gress | 439/137 |
| 3,865,456 | 2/1975 | Dola | 339/40 |
| 4,293,733 | 10/1981 | Royer | 339/36 |
| 4,640,564 | 2/1987 | Hill | 339/40 |
| 4,722,693 | 2/1988 | Rose | 439/137 |
| 4,798,916 | 1/1989 | Engel et al. | 439/137 |

*Primary Examiner*—P. Austin Bradley
*Attorney, Agent, or Firm*—Wells, St. John & Roberts

[57] ABSTRACT

An electrical outlet protective cover 10 is described for mounting to ungrounded or grounded electrical outlet receptacles for preventing a child from inserting a foreign object into the receptacle or from inserting an electrical plug. The cover 10 has a back plate 52 with receptacle apertures 68, 70 for receiving the receptacle. The cover has a front panel 54 substantially forward of the back plate 52 forming shutter cavities 56 therebetween. Shutters 60, 62 are slidably mounted in the cavities 56 for horizontal movement between offset positions and aligned positions. Each of the shutters 60,62 have slots or apertures 88, 90, 92 for receiving corresponding electrical plug progngs. The slots 88 and 90 are of an enlarged size to accommodate ungrounded prongs or grounded prongs. The cover 10 has plug passageways 76 and 78 aligned with the receptacle apertures 68 and 70 respectively for preventing a child from touching the prongs when a plug is being inserted into a receptacle. To insert a plug, one must first insert the prongs of the plug into the shutter slots while the shutter is in the offset position. Then lateral force must be exerted on the plug to move the shutter from the offset position to the aligned position. When the shutter is moved to the aligned position, the plug is clear to be inserted into the passageway 76, 78 and into the receptacle.

5 Claims, 3 Drawing Sheets

Fig 1
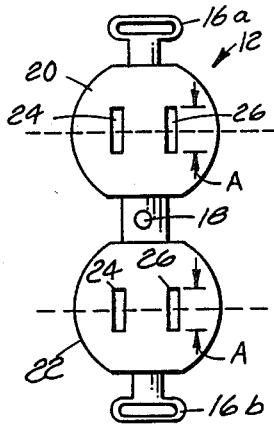
PRIOR ART
Fig 2
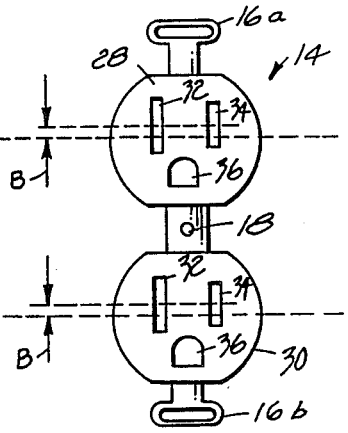
PRIOR ART
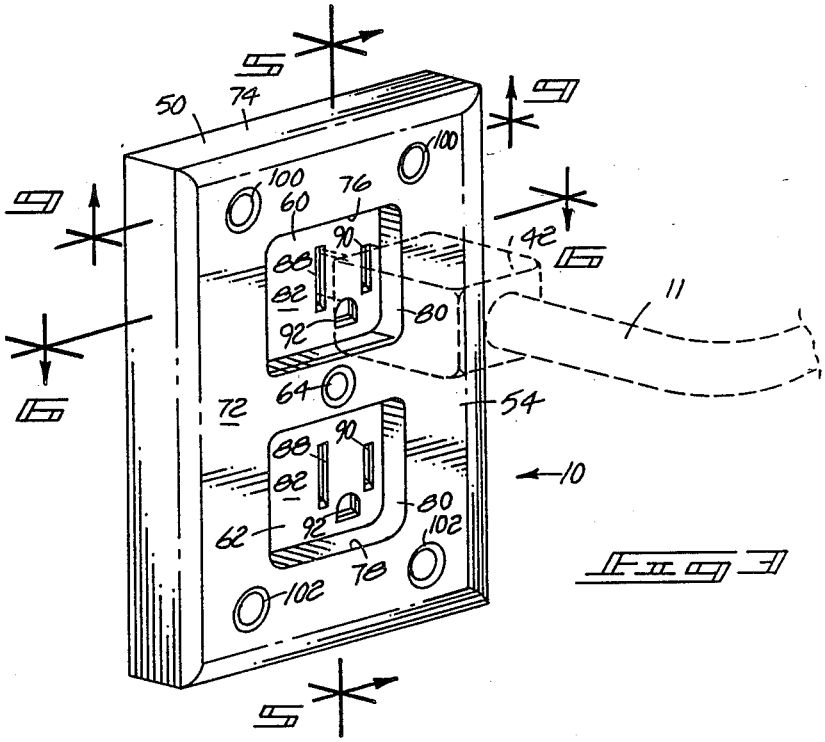
Fig 3

ELECTRICAL OUTLET PROTECTIVE COVER

TECHNICAL FIELD

This invention relates to electrical outlet protective covers that are classified in Class 439, subclass 137.

BACKGROUND OF THE INVENTION

It has been known for many years that electrical outlets, particularly in the home, present a serious safety hazard for children. Numerous attempts have been made to provide devices for minimizing the ability of children to receive electrical shocks from wall mounted electrical outlets.

Generally one of the objectives of the many devices is to provide some type of impedance to prevent a child from inserting a foreign metal object into an electrical outlet. Furthermore, it is frequently desirable to prevent or to minimize the ability of a child to insert the electrical plug of an appliance into the outlet so that the appliance will not be inadvertently energized.

Some attention has been given to the additional problem of a child touching the prongs of a male electrical plug is being inserted into or being removed from the outlet while the prongs are "hot". U.S. Pat. No. 4,293,733 granted to George R. Royer on Oct. 6, 1981 is directed to providing hollow cylindrical members that project outward from a wall outlet cover to minimize the ability of a child to touch exposed prongs of a male electrical plug. Such a feature is fairly unsightly and draws visual attention to the wall plug covering. Furthermore, it does not provide any feature for minimizing the ability of a child to insert the male plug into the socket.

Numerous wall outlet covering plates have been suggested having a shutter mechanism that is spring biased to prevent an electrical plug from being directly inserted into the outlet receptacle until the shutter is moved to an aligned position. Representative of such devices are U.S. Pat. No. 2,710,383 granted to Fitzpatrick et al. on June 7, 1955; U.S. Pat. No. 2,820,842 granted to Meistrell on Jan. 21, 1958; U.S. Pat. No. 3,068,442 granted to Kubik et al. on Dec. 11, 1962; U.S. Pat. No. 3,865,456 granted to Dola on Feb. 11, 1975; and U.S. Pat. No. 4,640,564 granted to Hill on Feb. 3, 1987. The latter two patents are capable of being used with grounded electrical outlet receptacles.

One of the principal objects of this invention is to provide a unique electrical outlet protective cover that is capable of being used either on ungrounded or on grounded electrical outlets.

A further object of this invention is to provide a very attractive appearing electrical outlet cover that is capable of preventing a child from touching or contacting the blades of a male electrical plug as it is being inserted into or removed from the outlet receptacle.

A further object of this invention is to provide a unique indicator means to provide a visual indication of a failure in the outlet cover to adequately prevent the direct insertion of a male electrical plug.

A further object of this invention is to provide a unique locking means for preventing the insertion of a male electrical plug into a receptacle until the locking means is released.

These and other objects and advantages of this invention will become apparent upon reading the following detailed description of a preferred and alternate embodiment.

BRIEF DESCRIPTION OF THE DRAWINGS

A preferred and alternate embodiment of this invention is illustrated in the accompanying drawings, in which:

FIG. 1 is a front view of a standard wall mounted electrical outlet having dual nongrounded electrical plug receptacles;

FIG. 2 is similar to FIG. 1 except showing a conventional electrical outlet having two grounded electrical plug receptacles;

FIG. 3 is a perspective view of an electrical outlet protective cover of a preferred embodiment of this invention illustrating in dotted line an electrical plug in which the electrical plug is not inserted into a corresponding outlet receptacle;

DETAILED DESCRIPTION OF A PREFERRED AND ALTERNATE EMBODIMENT

The following disclosure of the invention is submitted in compliance with the constitutional purpose of the Patent Laws "to promote the progress of science and useful arts" (Article 1, Section 8).

Figure 4:
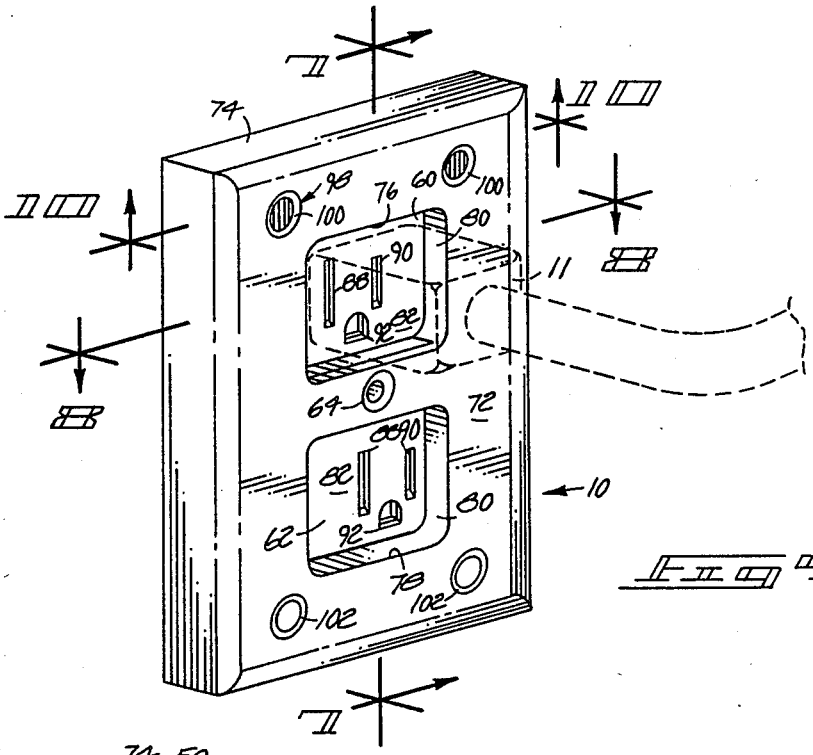
FIG. 4 is a perspective view similar to FIG. 3 except illustrating the insertion of the plug into the protective cover with the plug inserted into the corresponding outlet receptacle.

Referring to FIGS. 3 and 4, there is illustrated a preferred embodiment of an electrical outlet protective plate or cover generally designated with the numeral 10. The plate 10 is intended to provide a barrier between an electrical plug 11 and an electrical wall outlet (nongrounded) 12 or an electrical wall outlet (grounded) 14.

The ungrounded electrical wall outlet 12 includes mounting flanges **16*a* and 16*b*** for mounting the outlet to a wall or to a wall mounted outlet enclosure or box. The outlet 12 includes a center mounting hole 18 that is threaded to receive a bolt for centrally securing the protective plate 10 to outlet 12 or 14. The electrical outlet 12 includes an ungrounded upper receptacle 20 and an ungrounded lower receptacle 22. Each of the receptacles 20 and 22 has a horizontal axis illustrated by a dotted line in FIG. 1. Each of the receptacles 20 and 22 includes a female blade or prong slot (neutral) 24 and a female blade or prong slot (load) 26. Each of the slots 24 and 26 are parallel with each other and are vertically centered with respect to the horizontal axis of the receptacle. The height of the blade slot 24 and 26 is identified with a maximum dimension "A". Sometimes the height of the neutral slot 24 is greater than the height of the load slot 26. The dimension "A" represents the maximum height of either the slot 24 or the slot 26.

The electrical outlet 14 includes an upper grounded receptacle 28 and a grounded lower receptacle 30. Each of the receptacles 28 and 30 includes a blade or prong female slot 32 (neutral), a blade or a prong slot (load/-line) 34 and a grounded prong cavity 36. The slots 32 and 34 are offset by dimension "B" from a horizontal axis of the receptacle 28, 30 as illustrated in FIG. 2. The ground prong cavity is offset below the horizontal axis of the receptacle 28, 30.

For purposes of example, the male electrical plug 11 (FIGS. 3–6) is a grounded plug and has a base 42 with a projecting neutral male prong or blade 44 and a parallel load/line male prong or blade 46. The heights of blades 44 and 46 of a grounded electrical plug are different with the neutral blade 44 having a height of approximately 0.350 inches and the load blade 46 having a height of approximately 0.285 inches. The center line of the receptacle slots 32 and 34 are normally offset from the receptacles axis approximately 0.115 inches—dimension "B". The electrical plug 11 in one embodiment includes a ground prong or pin 48.

Figure 7:
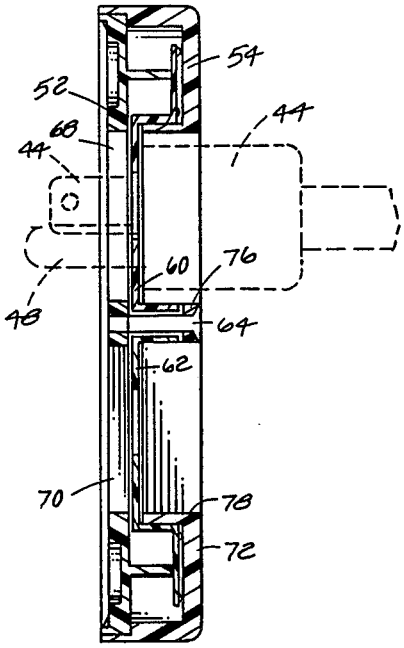
FIG. 7 is a vertical cross-sectional view taken along line 7—7 in FIG. 4 and similar to FIG. 5 but showing the plug in an aligned position and inserted into a respective receptacle.

The electrical outlet protective plate or cover 10 includes a plate body generally designated with the numeral 50 that includes a back panel 52 (FIGS. 5 and 7) and a front panel 54 mounted to the back panel. The front panel 54 extends outward from the back panel 52 a sufficient distance to provide a shutter cavity 56 (FIGS. 5 and 7) in theupper portion of the plate body and a shutter cavity 58 in a lower portion of the plate body 50 to accommodate prong shutters 60 and 62 respectively. The prong shutters 60 and 62 are mounted for horizontal slidable movement between an offset position illustrated in FIG. 3 to an aligned position illustrated in FIGS. 4, 7 and 8. The purpose of each of the prong shutters 60 and 62 is to prevent direct insertion of the electrical plug 11 into either of the receptacles of the outlets 12 or 14.

The electrical outlet protective cover 10 further includes a mounting aperture 64 that is adapted to be aligned with the center mounting hole 18 to receive a threaded bolt to secure and mount the plate 10 to the outlet 12, 14.

The back panel 52 includes a back surface 66 for engaging a wall surrounding the outlet 12, 14. The back panel 52 has an upper socket opening 68 to accommodate or receive the upper receptacle 20, 28 and a lower socket opening 70 for receiving the lower receptacle 22, 30. If properly mounted, the receptacles 20, 22, 28 and 30 extend out slightly from the wall to project into the socket openings 68 and 70.

Figure 8:
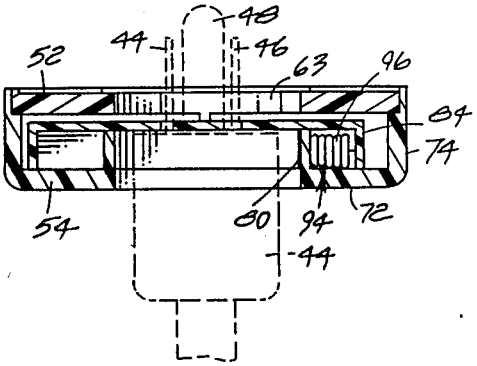
FIG. 8 is a horizontal cross-sectional view taken along line 8—8 in FIG. 4 and similar to FIG. 6 illustrating the plug in the aligned position with the prongs of the plug inserted into the corresponding receptacle.

The front panel 54 has a substantially flat front surface 72 substantially forward of the back panel 52. The front panel 54 has a peripheral surface 74 extending along the sides of the plate 10 between the front surface 72 and the back panel 52. The front panel 54 has plug passageways or recesses 76 and 78 formed in the front panel 54 extending rearward from the front surface 72 and complementarily aligned with the socket openings 68 and 70 of the back panel 52. Each of the plug passageways 76 and 78 has a passageway wall 80 of substantial depth that extends from the front surface 72 rearward to the prong shutters 60, 62. In a preferred embodiment, the front surface 72 extends outward from the socket openings 68 and 70 a distance sufficient so that the plug cannot be inserted into the receptacles 20, 22, 28 or 30 when the shutters 60, 62 are in the offset position illustrated in FIGS. 3, 5 and 6. Preferably the plate 10 is designed so that the front surface 72 is approximately 0.4 inches forward of the receptacles 10, 22, 28 and 30 to provide a ledge or barrier for preventing further insertion of the plug when the shutters 60, 62 are in the offset condition. Each of the plug passageways 76 and 78 has a cross-sectional area that is slightly greater than the maximum cross-section of the plug so that a child cannot touch an exposed blade while the plug is being inserted into the respective receptacle as illustrated in FIG. 8. Preferably each of the plug passageways 76 and 78 has a cross-sectional area of less than three square inches for accommodating the base 42 of the plug as illustrated in FIG. 8.

Each of the shutters 60 and 62 includes a central portion 82 with forward projecting edge portions 84. Each of the shutters 60 and 62 has a projecting extension 86 that projects vertically from an edge portion 84. The central portion 82 covers the receptacle opening 68 and 70 of the back panel 52 and encloses the plug passageways 78 and 80 respectively. The central portion 82 blocks and prevents direct insertion of the plug 11 into the passageways 76 and 78 and directly into the receptacles.

Central portion 82 of each of the shutters 60, 62 includes a neutral prong aperture or slot 88 and a parallel load prong aperture or slot 90 to receive corresponding neutral male prongs 44 and load male prongs 46 respectively. Additionally, the central portion 82 has a ground prong aperture 92 for receiving the ground male prong 48.

The neutral prong aperture 88 has a height that is sufficient to accommodate the insertion of either (1) the neutral male prong of a two prong electrical plug or (2) the neutral male prong of a three prong plug that is offset vertically as illustrated with respect to the receptacles illustrated in FIGS. 1 and 2 respectively. As previously mentioned, the normal height of the neutral plug blade is 0.350 inches. In the preferred embodiment, the height of the neutral prong aperture 88 is preferably approximately 0.380 inches or greater to accommodate the vertical offset (dimension "B") of the neutral prong 44 of a three prong plug. The load prong aperture 90 has a height of 0.315 inches to accommodate both two and three prong plugs. The ground prong aperture 92 corresponds with the size of the ground prong cavity 36.

The electrical outlet protective plate further includes a biasing means generally designated with the numeral 94 (FIGS. 6 and 8) for biasing each of the prong shutters 60 and 62 from the aligned position to the offset position. In the preferred embodiment, the biasing means 94 includes compression springs 96 positioned in the shutter cavities 56, 58 as illustrated in FIGS. 6 and 8. The compression springs 96 are positioned between the passage wall 80 and an edge portion 84 of the shutters 60, 62 for biasing the shutters 60, 62 to the offset positions illustrated in FIGS. 3, 5 and 6.

Figure 5:
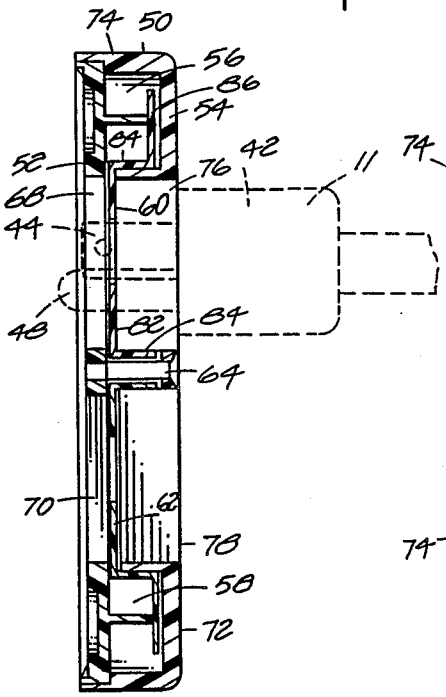
FIG. 5 is a vertical cross-sectional view taken along line 5—5 in FIG. 3 illustrating the electrical plug in an offset position.
Figure 6:
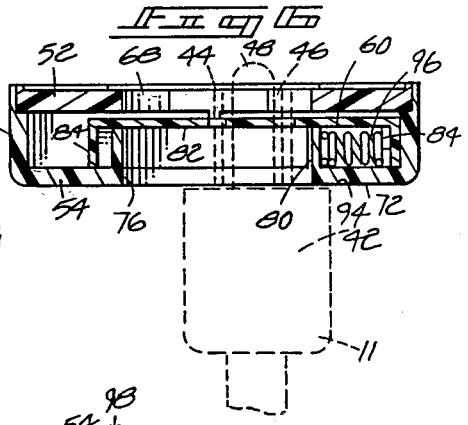
FIG. 6 is a horizontal cross-sectional view taken along line 6—6 in FIG. 3 showing the plug in an offset position.

To insert a plug 11 into a respective receptacle, the operator must first insert the plug prongs 44, 46 and 48 into the slots 88 and 90 and aperture 92 with the base 42 of the plug engaging the front surface 72 as shown in FIGS. 3, 5 and 6. Then the operator must exert a lateral force on the plug 11 to move the respective shutter 60, 62 to the left from the offset position toward the alignment position. Once the shutter 60, 62 is moved to the alignment position, then the operator may fully insert the plug into the passageway 78, 80 with the prongs moving into the respective slots 24, 26 or 30, 32 and 34 of the respective receptacles. Consequently, a person must perform two intentional acts, one aligning the plug prongs in the appropriate slots in the shutters 60, 62 and a second of moving the plug 11 laterally so that the plug base 42 may move into the restricted passageway 76, 68 with the shutter 60, 62 being in the aligned position.

It should be noted that while the plug is being inserted, a child cannot touch the blades of the plug 11 in a manner in which the child would receive an electrical shock. Furthermore, it should be noted that the shutters 60, 62 enable the same plate 10 to be utilized for either nongrounded outlets 12 or grounded outlets 14 without any adjustments.

Figure 9:
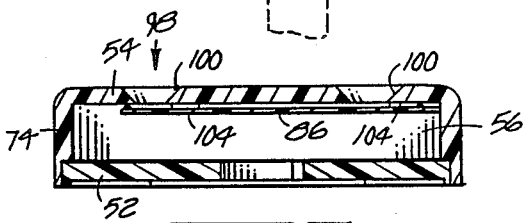
FIG. 9 is a horizontal cross-sectional view taken along line 9—9 in FIG. 3 illustrating a visual indicator means displaying that the protective cover is in an inactive position.
Figure 10:
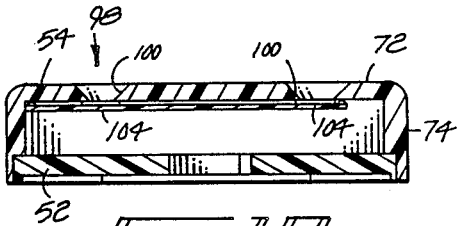
FIG. 10 is a cross-sectional view taken along line 10—10 in FIG. 4 and similar to FIG. 9 except showing the visual indicator means displaying that the protective cover is in an active condition.

Additionally, a preferred embodiment of the plate 10 includes a visual indicator means 98 that is illustrated in FIGS. 4, 9 and 10. The visual indicator means 98 is intended to provide a visual indication to the observer of whether the cover is operative to prevent the direct insertion of a male electrical plug. The visual indicator means 98 includes upper apertures 100 and lower apertures 102. The apertures 100 and 102 are formed through the front surface 52 to observe the projecting extensions 86 of the shutters 60, 62 as illustrated in FIGS. 9 and 10. The projecting extensions 86 have visual indicia or spots 104 formed thereon that are clearly visible when the shutters are in the aligned position to indicate that a plug is electrically connected to the associated receptacle 20, 28 and that the appliance attached to the plug is "hot". Additionally should the shutter fail to close upon removal of the plug, the visual indicia warns the viewer that the shutter may have become stuck or mechanically failed.

In a preferred embodiment, the spots or indicia 104 are of a bright color contrasting with a normal white or tan color of the remaining portion of the projecting extension 86 that is viewed when a shutter 60, 62 is in the offset position. As illustrated in FIG. 4, the visual indicia 104 is visible through the apertures 100 when the plug 11 is fully inserted into the corresponding receptacle 28, 28 through the plug passageway 78.

Figure 11:
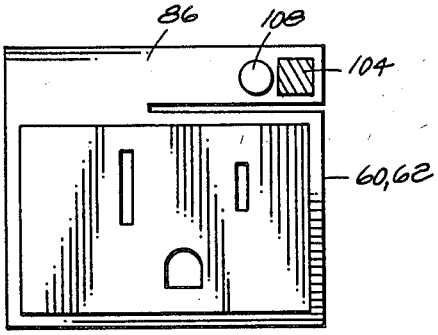
FIG. 11 is a fragmentary view of an alternate embodiment of a shutter illustrating a portion of a locking mechanism.
Figure 12:
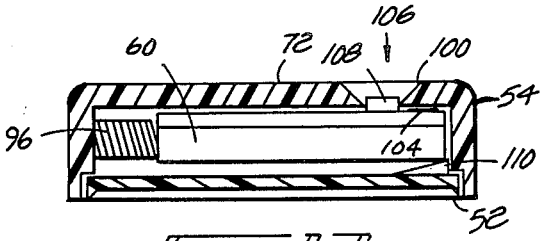
FIG. 12 is a cross-sectional view of the alternate embodiment illustrating the locking mechanism illustrated in FIG. 11 in which the locking mechanism is in the inactive position preventing movement of the shutter illustrated in FIG. 11.

In an alternate embodiment illustrated in FIGS. 11 and 12, the plate 10 includes a locking means generally designated with the numeral 106 for locking the shutters 60, 62 in the offset position until the locking means is released. In the alternate embodiment, the locking means 106 includes a projecting pin 108 mounted on the projecting extension 86 that extends into an aperture 100, 102 when the shutter 60, 62 is in the offset position. To release the pin 108, the operator pushes the pin 108 inward flexing the shutter 60, 62 so that the shutter may be moved from the offset position to the alignment position as previously described. In the alternate embodiment, the spring 96 is mounted between one side of the shutter and the front plate 54 in which the compression spring 96 is compressed when the shutter moves from the offset position to the alignment position. When a plug 11 is removed, the shutter is biased by the spring 96 toward the offset position. As the shutter is moved to the offset position, one side engages an inclined cam 110 to bias the pin 108 into a repsective aperture 100, 102. In this manner a positive locking mechanism is provided which must be released before the operator is able to move the plug in a lateral direction to position the shutter 60, 62 in the aligned position for inserting the plug fully into a respective receptacle.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An electrical outlet protective cover for preventing one from directly inserting an electrical plug into a receptacle of an electrical outlet on which the cover is mounted, in which the electrical plug has at least two electrical prongs extending a prescribed length from a plug base to prong ends, comprising:

a plate body for mounting to the electrical outlet having (1) a back panel having a back surface adapted to engage a wall surrounding an outlet and further having a receptacle aperture extending through the back panel for receiving a receptacle therein, (2) a front panel having a front surface spaced outward from the back panel and (3) a plug passageway formed therein extending between the front surface and the receptacle aperture for receiving the electrical plug therein;

a prong shutter mounted to the plate body for transverse sliding movement in the plug passageway between an aligned position and an offset position;

said prong shutter having prong apertures formed therein for receiving the plug prongs to prevent the plug prongs from being inserted into the receptacle when the shutter is in the offset position and to permit the plug prongs being inserted into the receptacle when the shutter is in the aligned position; and wherein the plug passageway has a length extending between the front surface and the back surface approximating the length of the plug prongs and providing a barrier at the front surface adjacent to the plug passageway for preventing further insertion of a plug when the shutter is in the offset position; and visual indicator means for visually indicating when the prong shutter is in the aligned position.

2. The electrical outlet protective cover as defined in claim 1 wherein the maximum cross-section dimension of the plug passageway is slightly greater than a maximum cross-sectional dimension of the plug to restrict a person from touching the plug prongs while the prongs are being inserted into the receptacle when the shutter is in the aligned position.

3. The electrical outlet protective cover as defined in claim 1 further comprising:

means for biasing the prong shutter to the offset position.

4. An electrical outlet protective cover for preventing one from directly inserting an electrical plug into a receptacle of an electrical outlet on which the cover is mounted, in which the electrical plug has at least two electrical prongs extending a prescribed length from a plug base to prong ends, comprising:

a plate body for mounting to the electrical outlet having (1) a rear panel with a receptacle aperture for receiving a receptacle therein, (2) a front surface spaced outward from the rear panel and (3) a plug passageway formed therein extending between the front surface and the receptacle aperture for receiving the electrical plug therein;

a prong shutter mounted to the plate body for transverse sliding movement in the plug passageway between an aligned position and a offset position;

said prong shutter having prong apertures formed therein for receiving the plug prongs to prevent the plug prongs from being inserted into the receptacle when the shutter is in the offset position and to permit the plug prongs being inserted into the receptacle when the shutter is in the aligned position; and visual indicator means for visually indicating when the prong shutter is in the aligned position.

5. The electrical outlet protective cover as defined in claim 4 further comprising:

locking means for releasably locking the shutter in the offset position.

* * * * *